United States Patent [19]

Rusche et al.

[11] Patent Number: 4,687,967

[45] Date of Patent: Aug. 18, 1987

[54] INFRARED IMAGE CATHODE RAY TUBE

[75] Inventors: Gerald A. Rusche, Fairfax City; Henry A. Forsch, Falls Church, both of Va.

[73] Assignee: The United States of America as represented by the Secretary of the Army, Washington, D.C.

[21] Appl. No.: 730,014

[22] Filed: May 3, 1985

[51] Int. Cl.[4] ..... H01J 31/00

[52] U.S. Cl. ..... 313/477 R; 313/478

[58] Field of Search ..... 313/477 R, 478, 471, 313/461, 474; 220/2.1 A

[56] References Cited

U.S. PATENT DOCUMENTS

| | | | |
|---|---|---|---|
| 3,406,068 | 10/1968 | Law | 313/470 |
| 3,878,428 | 4/1975 | Kuzminski et al. | 313/470 |
| 3,939,347 | 2/1976 | Shifrin | 324/158 R |
| 4,178,514 | 12/1979 | Bly | 250/493.1 |
| 4,299,864 | 11/1981 | Bly | 250/493.1 |
| 4,459,476 | 7/1984 | Weissmueller et al. | 340/365 P |
| 4,484,100 | 11/1984 | Sato | 313/477 R |
| 4,499,005 | 2/1985 | McColl et al. | 252/301.65 |
| 4,528,477 | 7/1985 | Gallaro | 313/477 R |
| 4,542,299 | 9/1985 | Scholz et al. | 250/252.1 |

*Primary Examiner*—Stewart J. Levy
*Assistant Examiner*—Hezron E. Williams
*Attorney, Agent, or Firm*—Max Harwell; Aubrey J. Dunn; Anthony T. Lane

[57] ABSTRACT

A cathode-ray tube with a target face consisting of electron-absorbing and infrared emitting islands of material on a thermally-conductive substrate. A modulated electron beam scanned over a regular array of such islands induces a mid or far infrared image in the array. The tube envelope has an infrared-transparent window through which the image may be viewed by infrared detectors or imagers.

2 Claims, 1 Drawing Figure

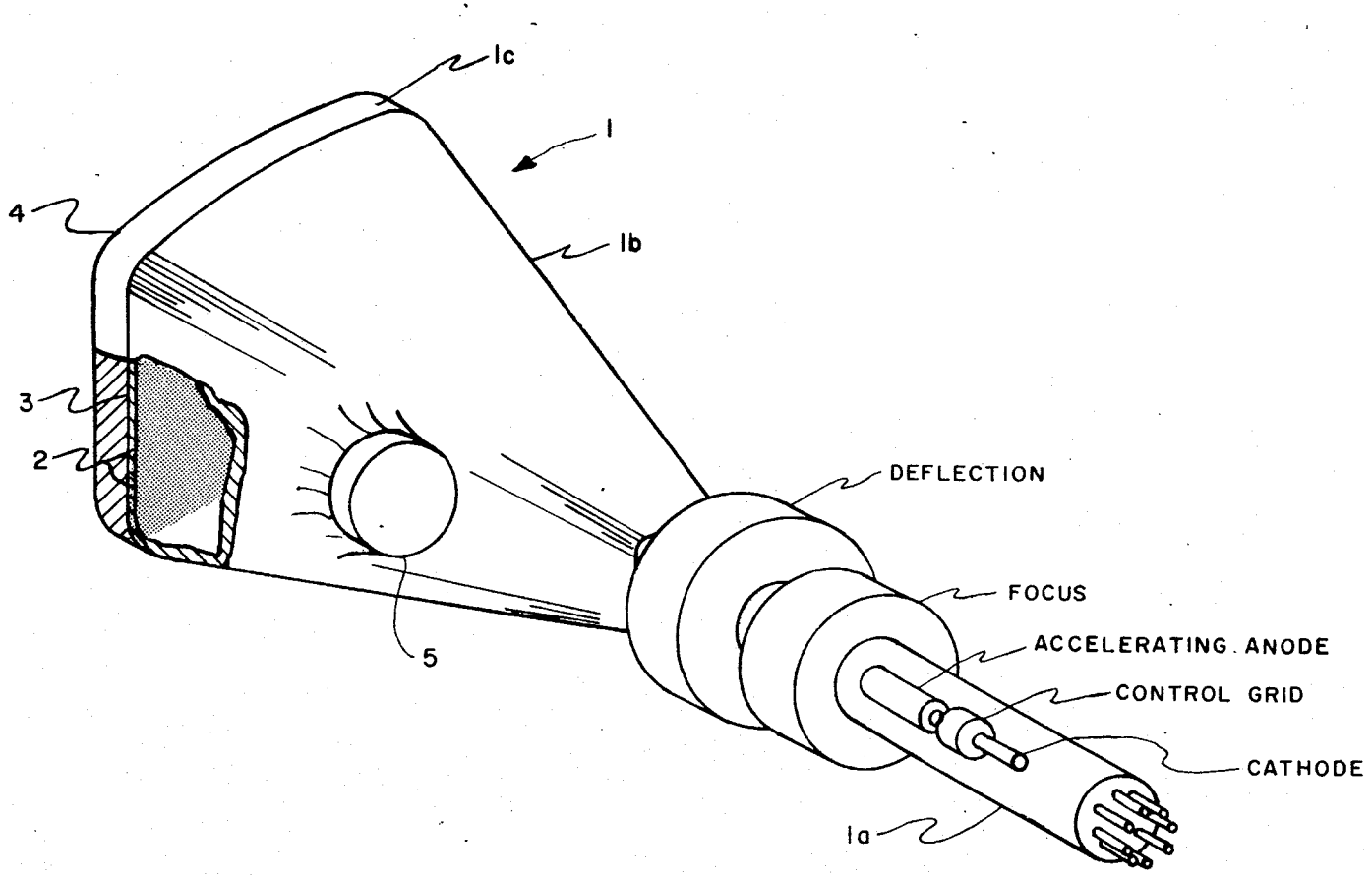
DEFLECTION
FOCUS
ACCELERATING ANODE
CONTROL GRID
CATHODE
1
1a
1b
1c
2
3
4
5

INFRARED IMAGE CATHODE RAY TUBE

The invention described herein may be manufactured, used and licensed by the U.S. Government for governmental purposes without the payment of any royalties thereon.

BACKGROUND OF THE INVENTION

This invention is in the field of devices for producing dynamic infrared images. Such devices are used to test various night vision systems. When testing night vision systems, a number of stimuli are employed: these range from wholly synthetic images, such as bar targets and other geometrical patterns, to actual live targets in natural scenes. The geometric patterns are needed to perform repeatable objective tests of such parameters as modulation transfer function, minimum resolvable temperature, resolution, etc. However, experience has shown that the complexities of the natural environment are such that they are not modeled adequately by synthetic images to provide a comprehensive evaluation of a system; consequently, knowledgeable testers resort to viewing natural scenes before judging a given system as acceptable. The advent of more advanced systems has exacerbated the problem. These are the automatic systems, which include automatic control functions such as auto gain, auto brightness, auto focus, auto level and auto responsivity controls, automatic target trackers, automatic target cuers, and automatic target recognizers, as well as combinations of any and all of the above functions. Testing of these systems invariably demands the use of images of natural terrain and targets because of the almost unsurmountable difficulty involved in producing validated synthetic images. The night vision testing community has recognized that there is a need for repeatable imagery of natural scenes. That is, imagery that has been recorded, and can be reproduced repeatedly in a consistent fashion that would retain the same radiometric attributes no matter how many times it were reproduced. This can eliminate some of the variables encountered in field trials, where there are day-by-day, hour-by-hour and sometimes minute-by-minute changes in the scene conditions. This makes it difficult to compare different systems or even the same system employing different parameters or different algorithms. It is highly desireable to test entire systems' performance, as there are sometimes unexpected and often subtle interactions between the individual components. This is done by observing and measuring the output while inputting an image. Such a test is reasonably easy to accomplish with the image intensifier class of devices, as they operate in the visible and near infrared regions of the spectrum, and thus can use slightly modified film projectors, and other readily obtainable image sources. In addition, there are available CRT's with phosphors having significant output in the near-IR. Producing equivalent images in the longer wavelength portion of the infra-red spectrum has been far more difficult, and less work has been done in the past on this, because of its very limited application. As described above, the simplest form of test target used for evaluating an infrared device has been the geometrical targets. These are typically stencil-like reticles which are cut out of a thin sheet of metal. A blackbody source is placed behind the reticle, and because the surface of the reticle is of a different temperature from the source, a condition of thermal contrast then exists. These reticle targets are used for objective tests of specific parameters, but are of very limited usefulness for evaluating complex automatic systems. One of the methods which have been used to generate repeatable images of natural scenes is: printing half-tone images on sheet- metal substrates and affixing these to a heated metal panel. Heat from the panel is conducted through the interface to the substrate. Differences in emissivity of the bare metal substrate and of the halftone image inscribed on it cause apparent delta T's. A more advanced approach is the "Bly Cell". (U.S. Pat. Nos. 4,178,514 of Dec. 11, 1979, and 4,299,864 of Nov. 10, 1981). In this approach an extremely thin membrane is mounted in an evacuated cell with a window parallel to the membrane on each side. The membrane is coated with a material such as gold black, which absorbs photons at one wavelength and re-radiates them at another wavelength. In this case, the wavelength of the input signal is in the visible to near-infrared portion of the spectrum. The output is wideband, approximating a blackbody emitter. The Bly Cell is used as follows: a visible image is projected, using an intense light source, onto the membrane. The recording medium for the image may be either a slide transparency or motion picture film. The output is then observed by an infrared device under test. The disadvantages of the heated panel approach are several: the substrates are costly to make and require considerable manual handling; the range of apparent delta T is limited; only static images are practical; reflections from objects in the simulator viewing chamber cause artifacts in the image and; the substrates must be manually placed on the panel. While the Bly Cell is an improvement over reticles and heated panels, it still has several disadvantages: its power sensitivity is low, making it unsuitable for use with a cathode ray tube output image; it is difficult to construct, and is therefore expensive; apparent delta T's are limited to a few degrees C. Earlier, when most advanced night vision imagery was being collected from image intenifier devices, the recording medium was primarily either still or motion picture film. However, for many reasons, this has been supplanted almost entirely by video tape. Video tape has many advantages, including ease of operation, consistency of performance, ease of interface, and the ability to be reviewed immediately after recording, without processing. The advent of the digital scan converter and of high bit rate digital recording extends this capability even further by permitting the recording of extremely wide dynamic range, high resolution, and high quality imagery. The instant invention overcomes the disadvantages of the prior art devices, particularly since it is capable of using to advantage video recorded data.

SUMMARY OF THE INVENTION

The invention is a cathode ray tube capable of producing a dynamic mid-or-far-infrared image with a wide delta T. The tube includes a target face on a faceplate, onto which an electron beam is directed. The target face consists of a regular array of islands of electron-absorbing material. The material emits mid-or-far-infrared radiation in accordance with the number of electrons falling thereon. The faceplate is cooled or warmed to some desired nominal temperature.

BRIEF DESCRIPTION OF THE DRAWING

The single drawing FIGURE is an isometric/-schematic view of the invention, partially cut away.

DESCRIPTION OF THE PREFERED EMBODIMENT

The invention may be best understood when this description is taken in conjunction with the drawings. In the drawing, reference numeral 1 generally designates a cathode ray tube (CRT) envelope including a neck portion 1*a*, a cone portion 1*b*, and a faceplate 1*c*. The tube is made of glass (the usual material for a CRT) and has the usual cathode, control grid, accelerating anode, and focus and deflection coils in and around neck portion 1*a*. The novelty of the invention begins at the faceplate of the tube. Instead of the normal phosphor on a transparent end of the glass envelope, we have a unique target face which consists of a closely-spaced regular array of electron-absorbing and mid-or-far-infrared emitting islands or mesas 2 on metal substrate 3. The substrate has thereon heater/cooler 4 for maintaining the substrate at some desired nominal temperature, which may be above or below ambient. Another novel feature of tube 1 is mid-or-far-infrared transparent window 5 formed on cone portion 1*b* of the tube. One is thus able to test infrared devices by "looking" at the image or images on the target face, through window 5.

It should be understood that a static or dynamic image may be fed as a video signal to the control grid of the CRT, and that the normal signals/biases are applied as for a normal CRT. Preferably, the video source is a video recorder of some type, such as a disc or tape recorder. In any event, a high-quality video signal is desired, and will yield a high-quality infrared signal.

The general requirements of the target face are: the islands must be of a material with a lower thermal conductance than the substrate; the material must be a good electron absorber, and capable of radiating photons in the mid-to-far infrared spectrum in response to such absorbtion and; there should be little or no webs between the islands. Moreover, the thermal time constant of the target face must be optimized to provide the maximum temporal storage without causing objectionable smear. This is analogous to the selection of phosphors with the desired persistance for conventional CRT's. The time constant is dependent on such things as thermal conductivity of the substrate and of the islands, of island volume and form, and of island and substrate materials.

A particular embodiment of the invention which we have made uses a steel alloy substrate with potassium chloride islands in the shape of approximately one mil diameter round discs, one mil thick spaced a little more than one mil apart on centers. A heater/cooler is bonded to the substrate and may be adjusted to provide a desired background temperature. This heater/cooler may be a fluid-filled plate, a thermoelectric device, or other equivalent devices. An alternate island material is "F" center phosphor; an alternate substrate material is copper.

The invention as just described, in order to be fully effective, must be (and is) capable of the following things: able to display images recorded on standard video tape, in standard EIA RS 170, RS 330, and RS 343 formats, as well as high bit rate digital tape recorded in the format approved by the Joint Military Working Group on Automatic Systems; resolution must be equal to or better than the infrared device under test; able to develop wide temperature differentials (delta T)—at least 100° C. delta T is desirable, and more would be better; must have a wide dynamic range capability (greater than 60 dB); must be able to provide various background temperatures for use with radiometric (DC coupled) sensors and; must introduce no artifacts or distortions in its image.

OPERATION OF DEVICE

The operation of the inventive CRT should be essentially obvious from the preceeding description. An electron beam is provided by the CRT cathode, is modulated in intensity by a video signal applied to the control grid and, is accelerated, focussed and deflected to fall on the target face in a raster pattern. The amount of power in the beam and its dwell time on a particular island (among other things) determine the temperature of that island. The different temperatures to which the islands are heated by the electron beam as it is modulated define the infrared image.

While we have described our islands as being circular discs other shapes may be used, and may have their own advantages (and disadvantages). For example, rectangular discs would cover more of the target area, but might have excessive thermal leakage between them. In order for a device under test to see an undistorted infrared image while looking at the target area off-normal, it may be necessary to electronically distort the image by keystoning. Alternatively, the electron gun, etc. could be mounted off-axis of the tube, with electron beam bent to provide an undistorted image, and with the viewing window on-axis of the tube. Although we have discussed only mid-and-far-infrared images in our invention, it should be understood that the islands are essentially black-body radiators, and may emit in both visible and near infrared, as well as mid-and-far-infrared. For observing infrared images, window 5 may be made of germanium.

We claim:

1. A cathode-ray tube for producing an infrared image, wherein said tube includes an envelope having a faceplate, a cone portion, and a neck portion, means for producing an electron beam, means for modulating, for accelerating, for focusing, and for deflecting said electron beam, wherein said faceplate includes a target face consisting of a metal substrate with a regular array of electron-absorbing and infrared-emitting islands or mesas thereon, wherein said mesas or islands are within said envelope and onto which said electron beam scans as deflected, and an infrared-transparent window in said cone portion through which said target face may be viewed, wherein said target face produces an infrared image in response to said electron beam.

2. The cathode-ray tube as set forth in claim 1 including means for controlling the temperature of said faceplate.

* * * * *